United States Patent [19]

Becher et al.

[11] 3,969,403

[45] July 13, 1976

[54] PROCESS FOR PREPARATION OF 2-METHOXY-3,6-DICHLORO-BENZOIC ACID

[75] Inventors: Heinz Manfred Becher, Bingen (Rhine); Richard Sehring, Ingelheim am Rhein, both of Germany

[73] Assignee: Celamerck GmbH & Co. KG, Ingelheim am Rhein, Germany

[22] Filed: Oct. 1, 1975

[21] Appl. No.: 618,561

Related U.S. Application Data

[63] Continuation-in-part of Ser. No. 480,685, June 19, 1974, Pat. No. 3,928,432.

[30] Foreign Application Priority Data

June 22, 1973 Germany ..... 2331712

[52] U.S. Cl. ..... 260/521 H

[51] Int. Cl.[2] ..... C07C 65/02

[58] Field of Search ..... 260/521 H, 521 B, 523 A; 204/73 R, 59

[56] References Cited

UNITED STATES PATENTS

| | | | |
|---|---|---|---|
| 3,013,054 | 12/1961 | Richter | 260/521 H |
| 3,356,737 | 12/1967 | Richter | 260/521 H |
| 3,970,974 | 10/1975 | Hokama | 260/521 H |

*Primary Examiner*—Lewis Gotts
*Assistant Examiner*—D. R. Phillips
*Attorney, Agent, or Firm*—Hammond & Littell

[57] ABSTRACT

An improved method of preparing 2-methoxy-3,6-dichloro-benzoic acid which comprises the step of oxidizing 2-methoxy-3,6-dichloro-benzyl alcohol into the correspondingly substituted benzoic acid, where the improvement resides in that the said benzyl alcohol is prepared by catalytically de-brominating 2-methoxy-5-bromo-3,6-dichloro-benzyl alcohol.

6 Claims, No Drawings

PROCESS FOR PREPARATION OF 2-METHOXY-3,6-DICHLORO-BENZOIC ACID

This is a continuation-in-part of copending application Ser. No. 480,685 filed June 19, 1974, now U.S. Pat. No. 3,928,432.

This invention relates to novel processes for the preparation of 2-methoxy-3,6-dichloro-benzoic acid.

We have discovered that this compound, which is a known herbicide, can unexpectedly be prepared in an advantageous manner by catalytically de-brominating 2-methoxy-5-bromo-3,6-dichloro-benzyl alcohol, and oxidizing the 2-methoxy-3,6-di-chloro-benzyl alcohol thus obtained.

More particularly, the present invention relates to the novel method of preparing 2-methoxy-3,6-dichloro-benzoic acid by catalytically debrominating 2-methoxy-5-bromo-3,6-dichloro-benzyl alcohol to produce 2-methoxy-3,6-dichlorobenzyl alcohol, oxidizing said 2-methoxy-3,6-dichloro-benzyl alcohol to produce 2-methoxy-3,6-dichloro-benzoic acid, and recovering said 2-methoxy-3,6-dichloro-benzoic acid.

The novel process may be illustrated by reference to the following schematic reaction sequence:

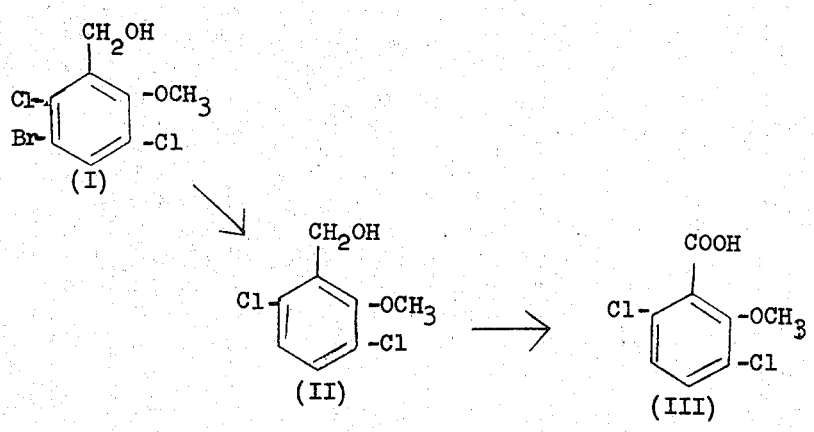

The starting compound I is readily available in accordance with conventional processes of preparation from 4-bromo-2,5-dichlorophenol by hydroxymethylation and methylation of the phenolic hydroxy group.

The catalyst for the catalytic debromination from I to II is preferably palladium, especially in the form of palladium-on-charcoal. The solvent is, for example, methanol, preferably in admixture with water or, optionally, with the addition of an acid acceptor, such as sodium acetate or sodium hydroxide. Inert organic solvents or mixtures of solvents can be used as the reaction medium, too, for example benzene or cyclohexane. An acid acceptor, such as sodium acetate, is preferably added and, if required, the reaction is conducted under slightly elevated pressure.

The smooth course of the reaction in accordance with the present invention was not predictable or forseeable, since undesired reactions, especially of the benzylalcoholic hydroxyl group, were to be expected.

The oxidation of the benzyl alcohol of the formula II to the benzoic acid of the formula III readily proceeds by means of conventional oxidation agents, for example with potassium permanganate in a heated aqueous alkaline solution. Other oxidation agents, such as nickel peroxide, can be used as well. For the production of greater quantities of the acid, the preferred method of oxidation is with oxygen in the presence of a catalyst, for example finely dispersed platinum.

The following example illustrates the present invention and will enable others skilled in the art to understand it more completely. It should be understood, however, that the invention is not limited solely to the particular examples given below.

EXAMPLE 1 a. 2,5-dichloro-4-bromophenol was hydroxymethylated in alkaline aqueous solution with excess formalin at 40°C using a procedure analogous to that described in U.S. Pat. No. 2,631,169, to prepare 2-hydroxy-3,6-dichloro-5-bromo-benzyl alcohol.

b. In a solution of 45 gm of sodium hydroxide in 1 liter of water, 244 gm (0.90 mol) of 2-hydroxy-3,6-dichloro-5-bromo-benzyl alcohol were dissolved. Subsequently, while stirring at 50°C, 142 gm (1.13 mols) of dimethylsulfate were added in the course of 1 hour. Then, the reaction mixture, which became weakly acid, was made alkaline by the addition of sodium hydroxide solution, and cooled. The product that crystallized out was vacuum-filtered off, washed with dilute sodium hydroxide solution and water, and dried. The yield was 168 gm (65% of theory) of 2-methoxy-3, 6-dichloro-5-bromo-benzyl alcohol, m.p. 84°–88°C [melting point after recrystallization from gasoline (b.p. 40°–80°C): 88°–90°C]. By means of acidification of the alkaline layer the unreacted phenol starting compound could be recovered (35%).

c. (1) A solution of 14.3 gm (0.05 mol) of 2-methoxy-3,6-dichloro-5-bromo-benzyl alcohol in a mixture of 200 ml of methanol and 50 ml of water was hydrogenated after the addition of 2 gm of 5% palladium/charcoal at normal pressure at 15° to 20°C. Then, the catalyst was vacuum-filtered off and washed with water. The methanol in the filtrate was distilled off in vacuo. The residue was twice extracted, each time with 50 ml of diisopropyl ether. The combined extracts were dried and evaporated to dryness in vacuo. The residue, which was first oily, became crystalline. The yield was 9.6 gm (99% of theory) of 2-methoxy-3,6-dichlorobenzyl alcohol m.p. 62°–66°C. According to the NMR-spectrum, the product was pure. The results of elemental analysis corresponded to theory.

(2) A solution of 71.5 gm (0.25 mol) of 2-methoxy-3,6-dichloro-5-bromo-benzyl alcohol in a mixture of 300 ml of methanol and 75 ml of water was hydrogenated after the addition of 3 gm of 5% palladium/charcoal at normal pressure at 30°–45°C. After about one-third of the theoretical quantity of hydrogen had reacted, a solution of 7.5 gm (0.188 mol) of sodium hydroxide in a mixture of 12.5 ml of water and 62 ml of methanol was added dropwise. The rate of dropwise addition was adjusted in accordance with the rate of hydrogenation; the quantity of base was kept below that needed for neutralization. The catalyst was then suction-filtered off, the filtrate was admixed with 100 ml of water, and the methanol was distilled off. The residue was extracted twice with 200 ml of diisopropyl ether. The combined extracts were dried and evaporated to dryness in vacuo. The residue crystallized gradually. The yield was 50.5 gm (98% of theory) of 2-methoxy-3,6-dichloro-benzyl alcohol, m.p. 62°–66°C. According to the NMR-spectrum, the product was pure. The results of elemental analysis corresponded to theory.

d. To a mixture of 10.35 gm (50 millimols) of 2-methoxy-3,6-dichloro-benzyl alcohol and 200 ml of water, adjusted to pH 8 with dilute sodium hydroxide solution, was added 1 gm of platinized asbestos, and the mixture was heated to 90°–95°C while stirring. At this temperature, oxygen was introduced into the mixture through glass frit, while stirring, whereby the pH-value decreased. When it had dropped to 6.5 again, it was readjusted to 10–10.5 by the addition of 0.5 N sodium hydroxide solution. Then, each time the pH value dropped to 8 again, 0.5 N sodium hydroxide solution was added, so that the pH-value again reached to 10 to 10.5. The reaction was finished when the pH-value of the reaction mixture did not change any more. Then, the reaction mixture was cooled to room temperature, and the pH-value was adjusted to approximately 11. After about 1 hour, the insoluble matter (catalyst and neutral organic substances) was vacuum-filtered off and washed with approximately 0.1 N sodium hydroxide solution. The alkaline filtrate was extracted with diisopropyl ether in order to remove neutral, organic substances. The aqueous layer was strongly acidified (pH 2) with concentrated hydrochloric acid, and then extracted with diisopropyl ether. The combined organic layers of this extraction were dried and evaporated. The oily residue was triturated with a small amount of benzene, whereby it became crystalline. The yield was 7.1 gm (64% of theory) of 2-methoxy-3,6-dichloro-benzoic acid, m.p. 105°–108°C. Titration with sodium hydroxide solution; equivalent = 224 (theory = 221). The results of elemental analysis corresponded to the theory. The portions of the starting material which did not oxidize to the final product could be recovered and re-used for the most part.

While the present invention has been illustrated with the aid of certain specific embodiments thereof, it will be readily apparent to others skilled in the art that the invention is not limited to these particular embodiments, and that various changes and modifications may be made without departing from the spirit of the invention or the scope of the appended claims.

We claim:

1. A process for the preparation of 2-methoxy-3,6-dichlorobenzoic acid comprising the steps of catalytically debrominating 2-methoxy-5-bromo-3,6-dichlorobenzyl alcohol to produce 2-methoxy-3,6-dichlorobenzyl alcohol, oxidizing said 2-methoxy-3,6-dichlorobenzyl alcohol to produce 2-methoxy-3, 6-dichloro benzonic acid, and recovering said 2-methoxy-3,6-dichlorobenzoic acid.

2. The process of claim 1, in which said debromination is effected by catalytic hydrogenation.

3. The process of claim 2, in which said hydrogenation is effected at normal pressure.

4. The process of claim 2, in which said hydrogenation is effected at slightly elevated pressure.

5. The process of claim 2, in which said debromination is effected in the presence of a palladium catalyst.

6. The process of claim 1, in which said oxidation is effected with oxygen in the presence of a catalyst.

* * * * *